United States Patent [19]

Nielsen et al.

[11] Patent Number: 4,655,981

[45] Date of Patent: Apr. 7, 1987

[54] METHOD OF PRODUCING A PLATE WITH A DECORATIVE PATTERN IN ITS SURFACE

[75] Inventors: Jens P. Nielsen, Storvorde; Johan C. Gregersen, Bagsvaerd, both of Denmark

[73] Assignee: Dansk Eternit-Fabrik A/S, Aalborg, Denmark

[21] Appl. No.: 731,678

[22] Filed: May 7, 1985

[30] Foreign Application Priority Data

May 9, 1984 [DK] Denmark ..... 2309/84

[51] Int. Cl.[4] ..... B28B 11/08; B28B 3/22

[52] U.S. Cl. ..... 264/162; 264/146; 264/148; 264/284; 425/220; 425/304

[58] Field of Search ..... 264/162, 146, 145, 284, 264/148; 425/304, 218, 220

[56] References Cited

U.S. PATENT DOCUMENTS

| | | | |
|---|---|---|---|
| 1,229,582 | 6/1917 | Butterworth | 264/162 X |
| 1,293,076 | 2/1919 | Fritzinger | 264/84 |
| 1,438,231 | 12/1922 | Goodenberger | 425/304 X |
| 1,672,938 | 6/1928 | Hervey | 264/162 X |
| 1,825,938 | 10/1931 | Brand | 264/284 |
| 1,888,376 | 11/1932 | Duty | 264/284 |
| 2,388,880 | 11/1945 | Stitt | 264/162 X |

FOREIGN PATENT DOCUMENTS

| | | |
|---|---|---|
| 2442070 | 3/1976 | Fed. Rep. of Germany . |
| 73039 | 1/1927 | Sweden . |

*Primary Examiner*—Philip Anderson

*Attorney, Agent, or Firm*—Merchant, Gould, Smith, Edell, Welter & Schmidt

[57] ABSTRACT

In order to produce a decorative pattern on the surface of a layer of material in a soft plastic condition, the surface is whipped by the free end portions of a plurality of flexible thread-like members. The whipping action provides random depressions in the surface. The thread-like members are preferably fastened to the peripheral surface of a rotatable body which is spaced from the surface to be treated at a distance which is substantially smaller than the length of the thread-like members, and the surface to be treated is moved in relation to the rotatable body while this body is rotated. By this whipping action it is possible to make surface patterns imitating a slaty surface or the surface of other natural materials. Such decorative surfaces may be made on layers of materials which are cut into plates or blocks for use as building materials after firing, setting or hardening of the material. As an example, the decorative pattern or structure may be made on plates to be used as roofing plates.

11 Claims, 3 Drawing Figures

METHOD OF PRODUCING A PLATE WITH A DECORATIVE PATTERN IN ITS SURFACE

BACKGROUND OF THE INVENTION

1. Field of the Invention

The present invention relates to a method of producing a decorative pattern on a surface of a layer of a material, which may, for example, be used for making plates, such as roofing plates, panels, tiles, tile blocks and other building blocks and other similar articles.

2. Description of the Prior Art

It is known to impress decorative patterns in the outer surfaces of bricks and building blocks by means of rotating brushes having relatively stiff bristles, the free ends of which engage with and roughen the surfaces of the bricks or building blocks while the material thereof is in a plastic condition before the bricks or building blocks are fired or set, vide for example Swedish Pat. No. 73,039 and U.S. Pat. No. 1,293,076. German Offenlegungsschrift No. 2,442,070 discloses an apparatus for providing a stripe structure on the surface of extruded ceramic plates. In this known apparatus, the surface of the extruded plate passes and engages with a comb or brush and with a sponge arranged downstream thereof. By these known methods and apparatus it is possible to produce plates, bricks and building blocks with a surface structure which is very uniform. As the surface structure or surface pattern of slate and other natural materials is normally not uniform, but comprises random and differently sbaped depressions, the known methods and apparatus are not able to imitate such natural surface patterns or to make other non-uniform surface structures or patterns.

SUMMARY OF THE INVENTION

The present invention provides a method of forming a decorative pattern on a surface of a layer of material in a soft, plastic condition, said method comprising whipping said layer surface by the free end portions of a plurality of flexible thread-like or string-like members so as to make depressions therein, and subsequently hardening said layer of material.

The term "whip" as used in this specification does not comprise a brushing or scratching action of the outer ends of bristles or other similar members. However, the term should mean that such a substantial length of the free end portions of the thread-like members is slung into engagement with the plastic surface of the layer of material that the said length is free to attain any of numerous shapes and orientations when hitting the said surface. This arbitrariness allows for the creation of a desired, non-uniform surface structure or pattern.

The whipping action may be performed in any suitable manner. Thus, for example, the thread-like members may be fastened to a body which is reciprocated or oscillated so as to perform the desired whipping action. In the preferred embodiment, however, the end of each thread-like member is fastened at the peripheral surface of a rotatable body which is spaced from the said surface of the layer of material, the length of each thread-like member substantially exceeding the distance between the peripheral surface of the rotatable body and said surface of the layer of material, said method further comprising rotation of said rotatable body and relatively moving said body and said layer. Thus, the rotatable body may be moved in relation to the layer of material while the body is rotated and/or the layer of material ma be moved in relation to the stationary, rotating body. The distance between the peripheral surface of the rotatable body and the surface to be treated is preferably maintained substantially constant, but may be slightly varied in order to create further variation in the surface structure or pattern produced.

By variation of a number of factors such as the material from which the string or thread lengths are made, the length of the strings or threads in relation to the radial distance between the outer surface of the rotatable body and the adjacent surface of said layer of material, the rotational speed of the rotatable body, the axial and peripheral distances between the string or thread lengths fastened to the body, the thickness or diameter of the strings or threads, and/or the direction of the axis of rotation of the rotatable body in relation to the direction of movement of the layer of material, it is possible to obtain different surface patterns and structures.

When the axis of rotation of the rotatable body extends at right angles to the direction of movement of the layer of material to be whipped, it has been found that the string or thread lengths may tend to become intertangled. This may be avoided by arranging the rotatable body so that the longitudinal axis or the axis of rotation thereof defines an acute angle with the direction of movement of the layer of material. This acute angle may be 0°–30°, preferably 10°–15°. It may be desired to provide a slate-like surface pattern or another "natural" surface pattern on the surface of the layer of material being whipped. In such a case it may be desirable to obtain a substantial variation of the surface pattern. This may, for example, be obtained by variation of said acute angle while said layer of material is being moved.

It is also possible to use more than one rotatable body for the said whipping process. In that case such rotatable bodies may be arranged so that their axes of rotation form different angles with the direction of movement of the layer of material.

The said layer of material may comprise fiber-reinforced or non-reinforced ceramic or clay material, cement mixtures, plastics materials and any other suitable material which may be treated in a deformable plastic condition and subsequently hardened, cured or set. The treated layer of material may be formed into or consist of plates, such as roofing plates, panels or the like, tiles, bricks, building blocks, ect.

The term "layer of material" as used in this specification should not only comprise flat shapes, but also other shapes, such as blocks and other bodies having at least one more or less flat surface which is to be treated.

According to another aspect, the present invention relates to an apparatus for forming a decorative pattern on a surface of a layer of material in a soft, plastic condition, said apparatus comprising at least one rotatable body having a plurality of flexible, thread-like members extending from the peripheral surface thereof, transporting means for transporting said layer of material along a path of movement extending past the peripheral surface of said rotatable body in spaced relationship and at a distance which is substantially shorter than the length of each of said thread-like members, and driving means for rotating said rotatable body so as to whip the surface of said layer opposite to said rotatable body by the thread-like members so as to make random depressions in said surface.

BRIEF DESCRIPTION OF THE DRAWINGS

The invention will now be further described with reference to the drawings, wherein.

DESCRIPTION OF THE PREFERRED EMBODIMENT

Figure 1:
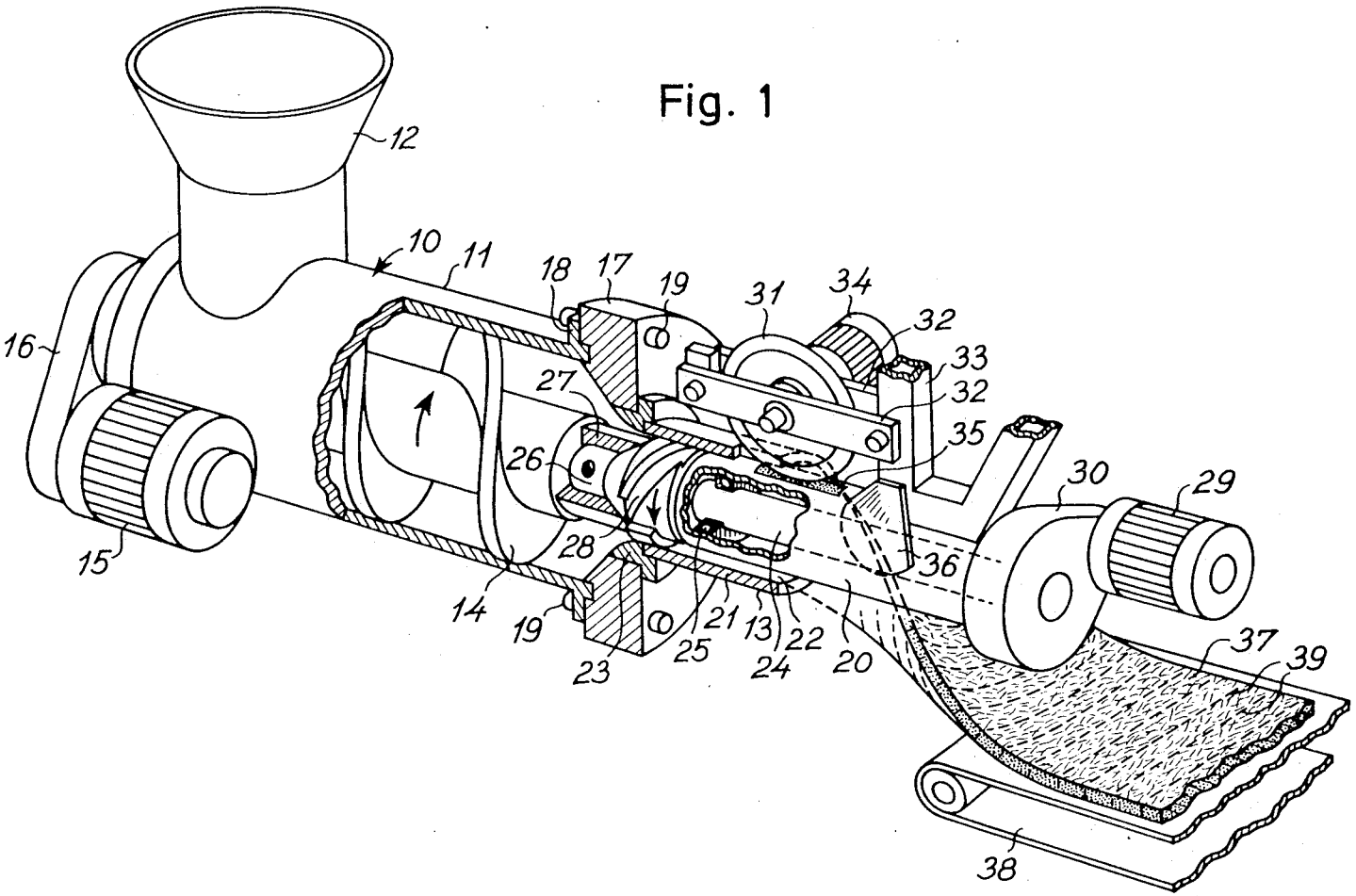
FIG. 1 is a perspective and partially sectional view of an extruder for making a fiber-reinforced layer of material.

FIG. 1 illustrates an extruder generally designated by 10 comprising a substantially cylindrical housing 11 with an upwardly extending material inlet 12 at one end and an axially extending extruder nozzle 13 at the other end. A conveyor screw 14 extends axially within the housing 11 and may be rotated by means of an electric motor 15 through a belt drive 16.

The extruder nozzle 13 is mounted in an end wall 17, which is fastened to a radially extending flange 18 on the housing 11 by means of bolts 19, and the extruder nozzle comprises inner and outer nozzle tubes 20 and 21, respectively, which define an annular nozzle passage 22 therebetween. The outer nozzle tube 21 is mounted on the end wall 17 by means of a mounting collar 23, and the inner end of the inner nozzle tube 20 is supported on a rotatable central shaft 24 by means of a ball bearing 25. An extrusion member 26 fastened to the inner end of the central shaft 24 is rotatably mounted in a bearing 27 and has a peripheral part extending radially into and obstructing the inlet end of the annular nozzle passage 22. A helically extending extrusion channel 28 is formed in the peripheral part of the extrusion member 26 and interconnects the inner space of the housing 11 and the annular nozzle passage 22. The shaft 24 and the extrusion member 26 mounted thereon may be rotated by means of an electric motor 29 through a suitable drive 30, such as a belt or chain drive.

A circular cutting knife 31 is rotatably mounted between a pair of longitudinally extending structural members 32 which form part of an extruder frame 33. The cutting knife 31, which is driven by an electric motor 34, is in contact with a backing pad 35 of a suitable non-metallic material.

In operation the electric motors 15 and 29 rotate the conveyor screw 14 and the extrusion member 26 in opposite directions as indicated by arrows in FIG. 1, and the electric motor 34 rotates the cutting knife 31. A formable plastic material or mass, such as a cement mixture, containing reinforcing fibres may now be fed into the material inlet 12. The rotating conveyor screw 14 then forces the material towards the inner surface of the end wall 17, which defines a funnel-shaped inlet to the annular passage 22. The formable mass which is continuously forced into contact with the rotating extrusion member 26 is forced to flow through the helically extending extrusion channel 28 as an extruded flow or stream which is continuously forced into the annular passage 22 in a helical arrangement. While the material is forced or extruded through the channel 28, the orientation of the fibres contained in the material tends to become more or less directed into the direction of movement through the channel 28. This means that the reinforcing fibres contained in the material being forced through the annular passage 22 downstream of the extrusion member 26 have a predominantly peripheral orientation. This predominantly peripheral orientation may to some extent be neutralized during the further extrusion of the material through the annular passage 22.

When the extruded cylindrical body formed by the formable material meets the cutting knife 31, the extruded body is continuously cut or slit along a generatrix, and the slit, extruded body may be flattened out by means of suitable guide members 36 extending outwards from the outer surface of the inner nozzle tube 20. Thus, the slit, flattened tubular body is formed into a flat layer 37 of material which may be passed onto a conveyor belt 38 or a similar conveyor device.

In FIG. 1 transversely extending, spaced dotted lines indicate the border lines between the now united turns of the helical stream or flow of material extruded into the annular passage 22. As indicated in FIG. 1, the reinforcing fibres in the layer 37 may be oriented more in the transverse direction than in the longitudinal direction of the layer. The orientation of the fibres may, however, to a high extent be varied by varying factors, such as the cross-sectional area and length of the channel 28, the rotational speed of the extrusion member 26, the cross-sectional area and the axial length of the annular nozzle passage 22 downstream of the extrusion member 26, and the extrusion pressure generated within the extruder housing 11.

Figure 2:
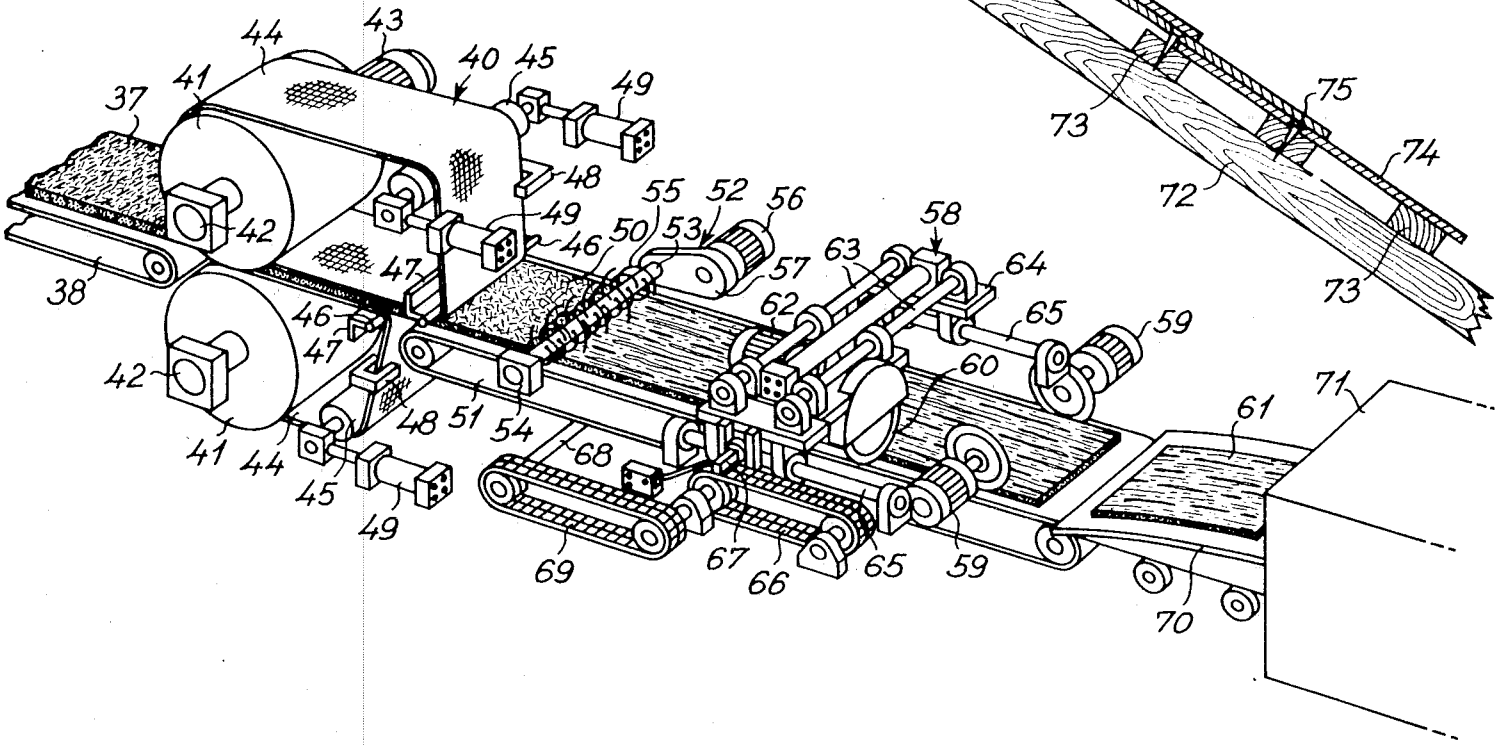
FIG. 2 is a perspective view of a rolling, surface treating, cutting and drying station for treating the layer of material formed by the extruder shown in FIG. 1 and comprising an embodiment of the apparatus according to the present invention.

As shown in FIG. 2, the conveyor belt 38 may move the flattened layer of material 37 to a roller station, which is generally designated by 40 and which may, for example, be of the type disclosed in published European patent application No. 82 105303.0. However, in the embodiment shown in FIG. 2, the roller station 40 comprises a pair of oppositely arranged rollers 41 which are rotatably mounted in bearings 42 in a frame, not shown, and the rollers 41 are rotated at the same rotational speed by means of synchronous motors 43. In order to ensure that the material 37 which is fed through the nip defined between the rollers will pass through the nip without sticking to the rollers, the material 37 is passed through a space defined between adjacent runs of a pair of gas-permeable endless belts 44. Each belt 44 is passed around an associated one of the rollers 41, a guide roll 45 and a cylindrical bar or roller 46, which has a small diameter and is stationary or rotatably mounted on a rib of an angle bar 47 extending transversely to the direction of movement of the belts 44. The belts 44 may be retained in the correct position on the rollers 41 by means of photocells, mounted in fork shape members 48, controlling pneumatic or hydraulic cylinders 49 by means of a suitable device (not shown).

When passing through the nip between the rollers 41 and the space defined between the adjacent runs of the belts 44, the layer of material 37 is rolled and compressed so that it obtains an increased width and a uniform, reduced thickness. The rolled layer of material 50 leaving the roller station 40 is passed onto a conveyor belt 51 and moved through a surface treating station 52. This station comprises a whipping device formed by a shaft 53, which is rotatably mounted in bearings 54 and extends above and adjacent to the upper surface of the layer of material 50 and transversely to the movement of this layer. A plurality of string or wire lengths have one end fastened to the peripheral surface of the shaft 53 which is rotated by an electric motor 56 through a belt or chain drive 57. When the shaft 53 is rotated by the motor 56, the uncured or unhardened upper surface of the rolled layer of material is whipped by the free ends of the string or wire lengths 55, whereby a desired textured pattern is imparted to the upper surface of the layer 50.

It should be noted that a whipping device as that shown in FIG. 2 may be used for treating a layer of material which has been made in any manner. Thus, for example, the layer of material may be extruded in its flat condition and may or may not contain reinforcing fibres.

From the surface treating station 52 the rolled layer of material 50 is moved to a cutting station 58, which comprises a pair of motor-driven rim cutters 59 for cutting the rolled layer of material 50 to a desired width, and a rotating cutter 60 for cutting the rolled layer of material 50 transversely into desired lengths or plates 61. The cutter 60 is driven by an electric motor 62 and moved reciprocatingly along transversely extending guide bars 63. Because the layer 50 should be cut transversely while the layer is moving in a longitudinal direction, the guide rods 63 on which the cutter 60 and the motor 62 are mounted are parts of a carriage 64 which may be moved along fixed guide rods 65 arranged on either side of the conveyor belt 51 and extending in the direction of movement of the belt 51 and the layer 50 supported thereby. In order to obtain a clean cut extending at right angles to the direction of movement of the layer 50, the carriage 64 must be moved in a forward direction along the guide rods 65 at a velocity identical to that of the upper run of the conveyor belt 51. The carriage 64 is connected to a chain drive 66 by means of a carrier member 67, which extends into a vertical slot or channel formed in the adjacent end of the carriage. The chain drive 66 is driven by the same motor as the conveyor 51 through a shaft 68 and second chain drive 69. As explained above, the chain of the chain drive 66 moves at the same speed as the conveyor 51. When the carrier 67 reaches the upper run of the chain and starts moving in the same direction and at the same speed as the rolled layer 50, the cutter 60 starts moving transversely along the guide rods 63, and the transverse cutting is terminated before the carrier 67 reaches the end of the upper run of the associated chain. When the carrier 67 moves along the lower run of the chain 66, the carriage 64 is returned to its starting position, and the cutter 60 may now be moved along the guide rods 63 in the opposite direction. It is understood that the length of each plate 61 will correspond substantially to the total length of the endless chain of the chain drive 66.

Each of the plates 61 cut from the layer 50 may be arranged on an upwardly convexly curved support plate 70, whereby the still formable plate 61 will obtain substantially the same curved shape. The plates 61 cut from the layer 50 and supported by curved plates 70 may now be passed into a hardening or curing station 71 where the plates are hardened or cured.

It should be understood that the plates 61, each of which is arranged on an upwardly convexly curved support plate 70, could be made in any other manner than that described above, and the plate may or may not contain reinforcing fibres. The advantages described below in relation to FIG. 3 may be obtained whether the plates are made by the extrusion method described above or by any other method.

Figure 3:
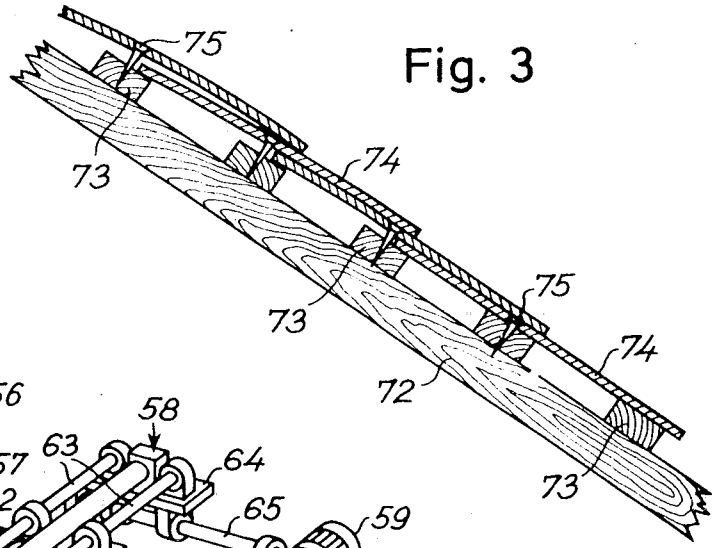
FIG. 3 is a sectional view of a roof structure comprising curved roofing plates.

FIG. 3 illustrates part of a roof structure 72 with a number of horizontally extending, parallel, mutually spaced laths 73 to which a plurality of curved roofing plates 74 of the type produced in the apparatus or plant shown in FIGS. 1 and 2, are fastened in an overlapping relationship. The central part as well as the upper and lower edges of each plate 74 overlie a lath 73, and the central part of each plate may be fastened to the underlying lath by means of one or two nails 75. The curved shape of the plate 74 then ensures that the upper edge thereof is resiliently pressed into engagement with the underlying lath 73 and that the lower edge of the plate is pressed into engagement with the central part of an underlying plate so as to cover the nail head or heads thereon.

EXAMPLE

Plates, such as roofing plates or the like, having a slate-like surface, may be made from a layer of hardenable or curable plastic material, such as a cement mixture containing reinforcing polypropylene fibers. This layer of material may be made by means of an extruder as that shown in FIG. 1, but can also be made in any other suitable manner. The layer of material is moved past a whipping device similar to the surface treating station 52 shown in FIG. 2. The string or wire lengths of the whipping device may be made from polyamide of the type used in grass trimmers as those marketed by Black & Decker. The string or wire lengths may, alternatively, be made from synthetic rubber of the type normally used for making O-rings and other sealing members. Any other sufficiently wear-resistant material having a suitable relationship between elasticity and specific weight such as steel wire may be used. The diameter of the string or thread lengths is preferably about 2 mm, and the axial spacing of the wire or string lengths on the rotatable supporting body or shaft 53 may be 5–25 mm, preferably 8 mm. Each string or thread length extends 150–250 mm from the outer peripheral surface of the shaft or body member 52, when the layer of material to be treated is moved past the shaft 52 so that the distance between the surface of the layer material to be treated and the peripheral surface of the shaft or body member 52 is 40–55 mm. The latter distance should be chosen in dependency of the rotational speed of the shaft or body member on which the wire or string lengths are fastened. Thus, for the above distance the rotational speed should be 1500–3000 rpm, preferably 2000–2100 rpm. The speed of movement of the layer of material past the whipping device is less critical. However, this speed of movement may, for example, be about 5 m/minute. The shaft or body member 52 may be mounted so that its axis of rotation extends at right angles to the movement of the layer of material to be treated. It has been found, however, that better results are obtained when the rotational axis of the rotating body 52 defines an acute angle with the direction of movement of the layer of material. This angle should normally not exceed 30° and is preferably 10°–15°. The layer of material which may, for example have a thickness of about 4 mm, may be cut into rectangular plates with a plate length of about 600 mm. Each of these plates is arranged on and supported by an upwardly convexly curved support plate where it is hardened or cured. The radius of curvature of the plate may, for example, be about 15 m, providing an arch with a rise of about 3–4 mm. The finished, cured plates are used as roofing plates in roof structures as illustrated in FIG. 3.

What is claimed is:

1. A method of producing a decorative pattern on the surface of a layer of material in a soft, plastic condition, said method comprising whipping said layer surface by the free end portions of a plurality of flexible thread-like members which are slung against the surface in a non-uniform manner and without abrading the surface, so as to make random depressions therein, and subsequently hardening said layer of material.

2. A method according to claim 1, wherein one end of each thread-like member is fastened at the peripheral surface of a rotatable body which is spaced from said surface of the layer of material, the length of each thread-like member substantially exceeding the distance between the peripheral surface of the rotatable body and said surface of the layer of material, said method further comprising rotating said rotatable body and relatively moving said body and said layer.

3. A method according to claim 2, wherein the layer of material is moved in relation to said rotatable body in a direction defining an acute angle with the axis of rotation of said body.

4. A method according to claim 3, wherein said angle is 0°–30°.

5. A method according to claim 4, wherein said angle is 10°–15°.

6. A method according to claim 3, further comprising varying said acute angle while moving the layer of material in relation to the rotatable body.

7. A method according to claim 3, wherein two or more rotatable bodies having axes of rotation forming different angles with said direction of movement are used.

8. A method according to claim 2, wherein the length of each thread-like member is at least twice the distance between the peripheral surface of the rotatable body and said surface of the layer of material.

9. A method according to claim 8, wherein the length of each thread-like member is 3–5 times said distance.

10. A method according to claim 2, wherein each layer is cut prior to hardening so as to form roofing plates therefrom.

11. A method according to claim 1, wherein said layer is made from a material selected from the group consisting of fiber-reinforced and non-reinforced plastic material, clay material and cement material.

* * * * *